US005897717A

United States Patent [19]

Hashimura et al.

[11] Patent Number: 5,897,717

[45] Date of Patent: Apr. 27, 1999

[54] HIGH STRENGTH SPRING STEEL AND PROCESS FOR PRODUCING SAME

[75] Inventors: Masayuki Hashimura; Masato Yanase, both of Muroran; Taisuke Nishimura; Takashi Otowa, both of Wako; Hiroshi Yarita; Ikuo Ochiai, both of Tokyo; Toshio Ozone; Masaaki Mikura, both of Nagoya, all of Japan

[73] Assignees: Nippon Steel Corporation; Honda Giken Kogyo Kabushiki Kaisha, both of Tokyo; Chuo Hatsujo Kabushiki Kaisha, Aichi, all of Japan

[21] Appl. No.: 09/041,473

[22] Filed: Mar. 11, 1998

[30] Foreign Application Priority Data

Mar. 12, 1997 [JP] Japan ..... 9-057479

[51] Int. Cl.[6] ..... C22C 38/22; C22C 38/24; C21D 9/02; C21D 8/00

[52] U.S. Cl. ..... 148/334; 148/580; 148/908

[58] Field of Search ..... 148/334, 908, 148/580; 420/110, 112

[56] References Cited

U.S. PATENT DOCUMENTS 4,909,866 3/1990 Abe et al. ..... 148/908

5,665,179 9/1997 Izawa et al. ..... 148/580

FOREIGN PATENT DOCUMENTS 58-27959 2/1983 Japan ..... 148/908

4-285142 10/1992 Japan .

07278747 10/1995 Japan .

07292435 11/1995 Japan .

*Primary Examiner*—Deborah Yee

*Attorney, Agent, or Firm*—Kenyon & Kenyon

[57] ABSTRACT

The present invention provides, at low cost, a valve spring steel having a tensile strength as high as 210 to 240 kgf/mm$^2$ after oil tempering. The high strength spring steel comprises, based on weight, 0.65 to 0.85% of C, 1.90 to 2.40% of Si, 0.50 to 1.00% of Mn, 0.70 to 1.30% of Cr, 0.10 to 0.30% of Mo, 0.20 to 0.50% of V, 0.01 to 0.04% of Nb and the balance Fe and unavoidable impurities and is subjected to heating at temperature of 1,050 to 1,250° C. and then to rolling so that carbides in the steel have a size of up to 0.15 $\mu$m in terms of equivalent circle. A valve spring having a tensile strength as high as 210 to 240 kgf/mm$^2$ after oil tempering and stabilized quality can be produced while the material cost is greatly reduced by decreasing costly alloying components as much as possible.

6 Claims, 4 Drawing Sheets

HIGH STRENGTH SPRING STEEL AND PROCESS FOR PRODUCING SAME

BACKGROUND OF THE INVENTION

1. Field of the Invention

The present invention relates to a valve spring steel having a strength as high as 210 to 240 kgf/mm$^2$ after oil tempering.

2. Description of the Related Art

Although JIS generally specifies the basic chemical composition system of valve spring steels, a steel having a tensile strength as high as 210 to 240 kgf/mm$^2$ cannot be ensured only by imitating the chemical composition system, and the steel thus obtained naturally has a limitation on the setting resistance. In contrast to the composition system, Kokai (Japanese Unexamined Patent Publication) No. 7-292435 discloses that composite addition of Si and Cr to a steel having a relatively low C content prevents the formation of a decarburized layer and ensures a strength of at least 190 kgf/mm$^2$. The patent publication also discloses that the effects are further increased by adding elements such as V, Ni, Mo, Nb and B.

For the basic chemical composition system having a high C content, attempts having been made to prevent the decarburization and improve the properties of a spring steel by allowing the steel to contain from 0.05 to 0.1% of Se as disclosed in Kokai (Japanese Unexamined Patent Publication) No. 7-278747. As explained above, decarburization is commonly prevented to improve the properties of a spring.

For a spring prepared by cold working without considering decarburization, Kokai (Japanese Unexamined Patent Publication) No. 4-285142 discloses a process wherein many costly alloying elements such as Cr and Mo are added to the steel in combination in large amounts, the surface hardness of the steel is adjusted to up to Hv 400 by heat treatment, and the steel is subsequently nitrided and shot-peened to have a surface hardness of at least Hv 900 while the breakage of the steel is prevented during spring formation. As described above, technologies for the preparation of springs have generally been developed to cope with highly strengthening spring steels using such costly alloying elements.

SUMMARY OF THE INVENTION

An object of the present invention is to provide a high strength spring steel which is excellent in spring formability at the time of cold forming, even though a low cost chemical composition system is employed, and which gives a high strength spring after forming.

To achieve the object, the present invention provides a high strength spring steel, which comprises, based on weight, 0.65 to 0.85% of C, 1.90 to 2.40% of Si, 0.50 to 1.00% of Mn, 0.70 to 1.30% of Cr, 0.10 to 0.30% of Mo, 0.20 to 0.50% of V, 0.01 to 0.04% of Nb and the balance Fe and unavoidable impurities, and the carbides in which have a size of up to 0.15 $\mu$m in terms of equivalent circle.

The present invention also provides a process for producing a high strength spring steel, comprising the steps of heating a steel which comprises, based on weight, 0.65 to 0.85% of C, 1.90 to 2.40% of Si, 0.50 to 1.00% of Mn, 0.70 to 1.30% of Cr, 0.10 to 0.30% of Mo, 0.20 to 0.50% of V, 0.01 to 0.04% of Nb and the balance Fe and unavoidable impurities at temperature of 1,050 to 1,250° C., and rolling the steel subsequently so that carbides in the steel have a size of up to 0.15 $\mu$m in terms of equivalent circle.

DESCRIPTION OF THE PREFERRED EMBODIMENTS

Figure 1:
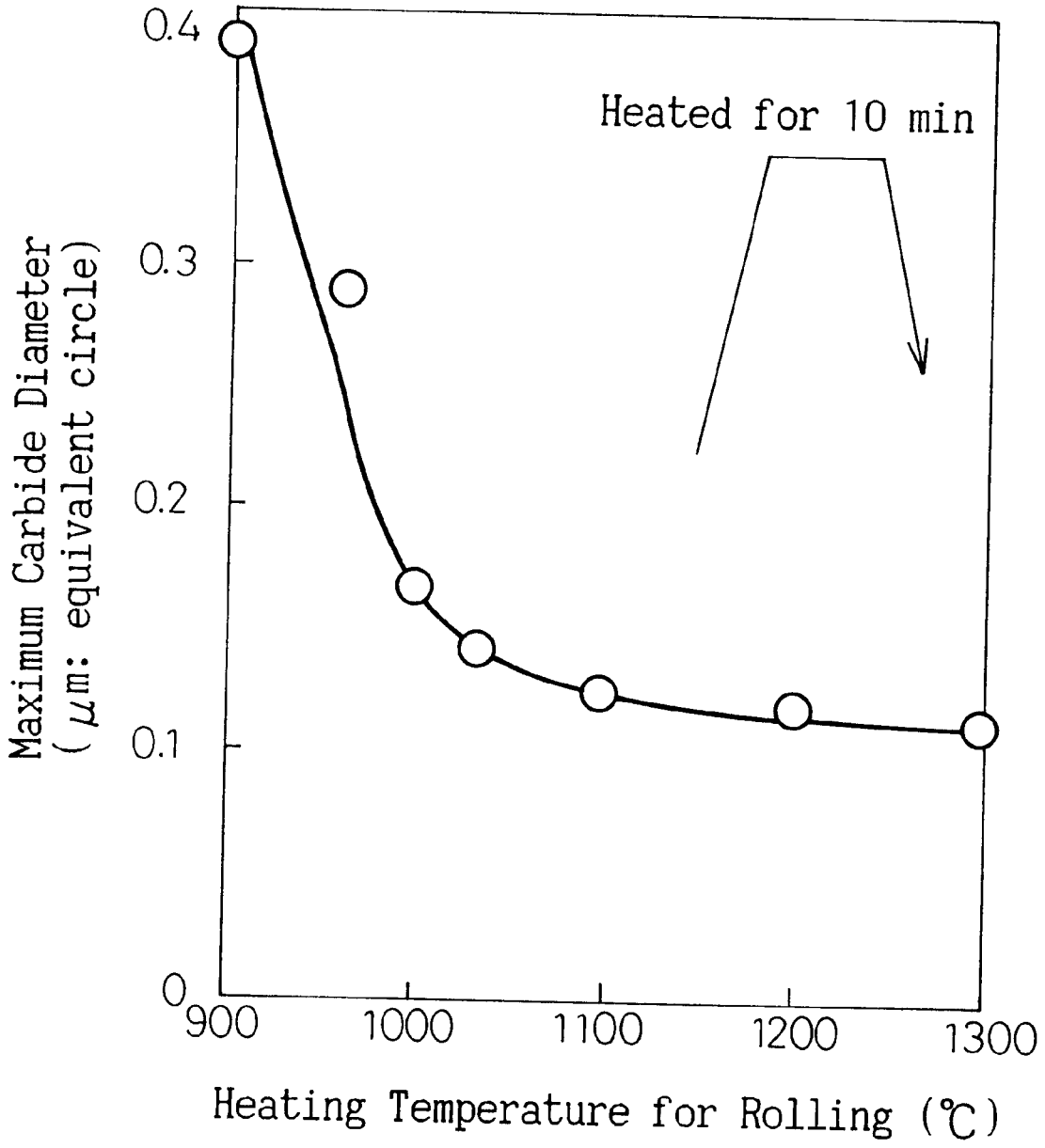
FIG. 1 is a graph showing the relationship between a heating temperature for rolling and a carbide diameter.

The present inventors have invented a high strength spring steel which is made to attain a necessary strength by cold coiling and subsequent nitriding and shot peening, while avoiding adding the large amounts of alloying components seen in many conventional technologies.

The chemical composition of the steel of the present invention is designed to prevent various troubles during processing such as rolling, and considers the formation of a decarburized layer prior to cold working and highly strengthened properties produced by nitriding and shot peening subsequent thereto. The details will be described below.

C is an element which greatly influences the fundamental strength of a steel material, and the C content is defined to be from 0.65 to 0.85% to give a sufficient strength. When the C content is up to 0.65%, a sufficient strength of the steel cannot be obtained. As a result, other alloying elements must be added further in large amounts. When the C content is at least 0.85%, the formability is significantly lowered.

Si is an element necessary for ensuring the strength, the hardness and the setting resistance of the spring. Since the strength and the setting resistance necessary for the spring becomes insufficient when the Si content is insufficient, the lower limit of the Si content is determined to be 1.90%. In order to prevent deterioration of the formability subsequent to oil tempering, the upper limit of the Si content is defined to be 2.40%.

Although Mn significantly increases the hardness after nitriding, it sometimes decreases the formability at the same time. Accordingly, the lower limit of the Mn content is defined to be 0.50% to give a sufficient hardness, and the upper limit is defined to be 1.00% to give a necessary formability.

Cr is an element effective in improving the heat resistance and the hardenability, and increasing the nitriding depth. However, addition of Cr in a large amount not only increases the production cost of the steel but also tends to form cracks in the steel during wire drawing. Accordingly, the lower limit of the Cr content is defined to be 0.70% to ensure the heat resistance and the hardenability, and the upper limit is defined to be 1.30% to decrease the formation of cracks during wire drawing.

Since Mo precipitates fine carbides and increases the resistance to temper softening, it is an element which gives the spring strength and toughness. However, since Mo is costly, it is preferred to suppress the addition amount as much as possible. Moreover, the steel containing Mo is confirmed to tend to form martensite, depending on the heat treating conditions. Accordingly, Mo is defined to be added in an amount of at least 0.10% to ensure the strength and toughness. In order to inhibit the formation of martensite under the patenting conditions of the present invention, the addition amount is defined to be up to 0.30%.

V is an element effective in improving the setting resistance and making the grains fine, and it has also the effect of improving the resistance to temper softening in the same manner as in Mo. In order to ensure the minimum hardness subsequent to nitriding, the lower limit of the addition amount is defined to be 0.20%. Since the size of VC type carbides exceeds 0.15 $\mu$m when the addition amount exceeds 0.50%, the upper limit thereof is defined to be 0.50%. The reasons for defining the diameter of the carbides will be described later.

Nb forms fine carbides, which have the effect of preventing grain coarsening. The carbide formation temperature is higher than that of V, and, therefore, the effect is shown in a high temperature region in actual rolling. Accordingly, Nb is an element important in preventing the grain coarsening. Addition of Nb even in a trace amount is important, and Nb cannot be replaced with V, etc. When the addition amount is up to 0.01% in heating at temperature of at least 1,050° C., the number of fine carbides becomes insufficient, and the grain coarsening cannot be prevented. Since the size of Nb inclusions exceeds 0.15 $\mu$m when the addition amount exceeds 0.04%, the upper limit is defined to be 0.04%.

During rough rolling, care must be taken not to have rolling defects formed in the steel in the following manner: water drops, which are formed when a rolling roll is cooled in conventional rolling, fall on the rolled steel material surface, and an abnormal structure leading to rolling defects is formed at the sites where the water drops have fallen. When the heating temperature is lower than 1,050° C., undissolved carbides remain in the steel, and the size of inclusions exceeds 0.15 $\mu$m. When the heating temperature exceeds 1,250° C., the austenite grains are coarsened. The heating temperature is, therefore, defined to be from 1,050 to 1,250° C. In addition, the heating temperature is preferably from 1,100 to 1,250° C. from a practical standpoint. Moreover, the rolling temperature subsequent to heating is preferably from 900 to 1,100° C.

In order to manifest excellent properties of the steel wire prepared from the steel of the present invention as an oil tempered steel wire, the steel wire is preferably patented at temperature of 600 to 700° C. The patenting promotes transformation of the steel, makes wire drawing easy, and prevents formation of wire drawing defects. When patenting of a steel wire prepared from the steel of the present invention is conducted at temperature lower than 600° C., formation of wire drawing defects cannot be avoided because the steel wire is not sufficiently softened. When the patenting temperature exceeds 700° C., the transformation does not proceed adequately.

An oil tempered steel wire having a strength as high as 210 to 240 kgf/mm$^2$ can be prepared from the steel wire thus prepared. As a result of continuing carrying out investigations to form springs from the oil tempered steel wire, the present inventors have found that the size of carbides in the steel significantly influences coiling by cold forming. The carbides in the steel have already precipitated when rolling is finished, and the adjustment of the carbides is very important. That is, when the size of the carbides in the steel wire having a strength as high as 210 to 240 kgf/mm exceeds 0.15 $\mu$m in terms of equivalent circle, breakage often takes place during cold coiling. Since the carbides in the steel never disappear in the process of heat treatment after rolling, the upper limit of the size of the carbides subsequent to finishing rolling is defined to be 0.15 $\mu$m in terms of equivalent circle.

EXAMPLES

Table 1 shows the chemical compositions of steels of the present invention and comparative steels. Steels in Examples 1 to 5 are the steels of the present invention having chemical compositions in claim 1. Steels refined in a converter (200 ton) were continuous cast to give billets. Some of the comparative steels in Examples 6 to 10 were melted in a converter (200 ton), and the other comparative steels were melted in a vacuum melting furnace (2 ton). Slabs were prepared from the molten steels prepared in the converter. Ingots were prepared from the molten steels prepared in the vacuum melting furnace (2 ton). The slabs and the ingots were bloomed to give billets. The billets were subjected to the steps of rolling-heating-Pb patenting-heating-oil hardening-tempering-cold forming (coiling)-annealing-nitriding-shot peening to give springs. The properties of the springs were evaluated. The steel wires prior to cold forming had been subjected to a wire-diameter coiling test to judge whether or not the steels could be cold formed. The details are shown in Table 2.

Next, the procedures of conducting evaluation tests for each of the steel materials will be explained. In order to evaluate the rolling ductility of the steel materials, the hot ductility thereof was measured by a Greeble testing machine. Each of the steel materials was heated in the experiments, cooled to the rolling temperature 950° C., and the reduction of area was measured. Concerning the carbides, a longitudinal cross-section of each of the steel wires was polished, and the polished surface was etched with a nital etchant. Electron micrographs (magnification of 6,500) of 50 fields of the polished surface were randomly taken using a scanning electron microscope. The size of each of the carbide particles observed in the fields was represented by the diameter of a circle (diameter of equivalent circle) having the same area as that of the carbide particle using an image processor. The maximum diameter of the carbides observed in the fields was determined.

In order to make the influence of the heating temperature in rolling clear, Formaster test pieces were prepared from part of the billet in Example 1 by forging and machining, and the size of undissolved carbides in the test pieces quenched from various temperatures was measured in the same manner. The fatigue characteristics of springs as the final products were evaluated. The fatigue characteristics of a spring were evaluated from the maximum amplitude at which the spring could withstand repeated loading ($N=5\times10^7$) under an average load stress $\tau_m$ of 686 MPa. The steel materials of the present invention and those in the comparative examples were each evaluated. Those steel materials which had an extremely low ductility or which showed a high breakage probability in the wire-diameter coiling test were not subjected to subsequent evaluation tests.

First, FIG. 1 shows the relationship between a heating temperature and a carbide size subsequent to oil quenching of test pieces which were prepared from part of a billet in Example 1 and which were quenched from various heating temperatures at the time of rolling. Large undissolved carbides were observed after quenching in the test piece the heating temperature of which had been 950° C.

Figure 2:
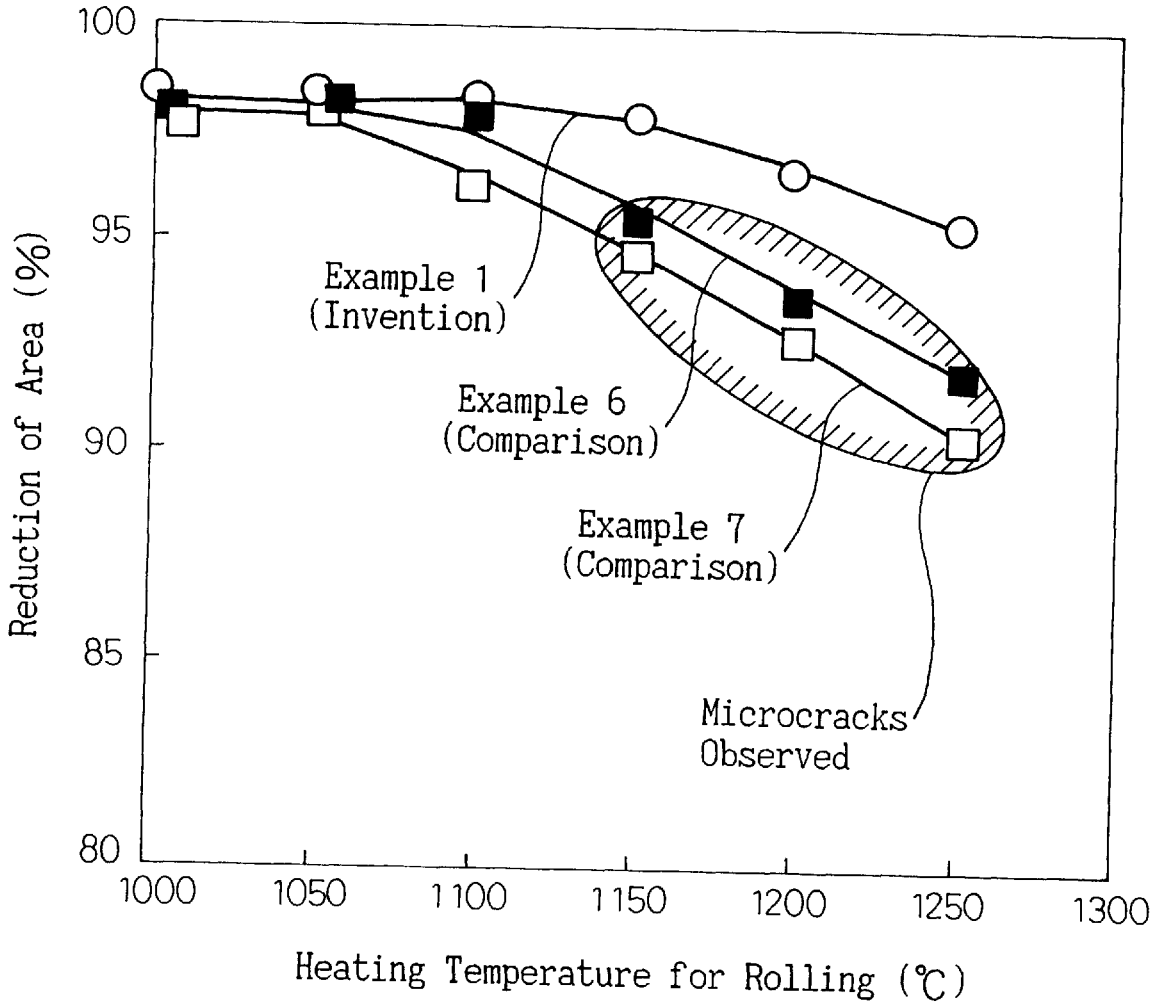
FIG. 2 is a graph showing the relationship between a heating temperature for rolling and a reduction of area in Greeble hot tensile test in Examples 1, 6 and 7.

FIG. 2 shows the relationship between a heating temperature at the time of rolling in Greeble test and a reduction of area on test pieces in Examples 1, 6 and 7. Those test pieces to which Nb were not added in Examples 6 and 7 showed an insufficient reduction of area in the rolling temperature range, and many microcracks were observed in the test pieces themselves.

Figure 3:
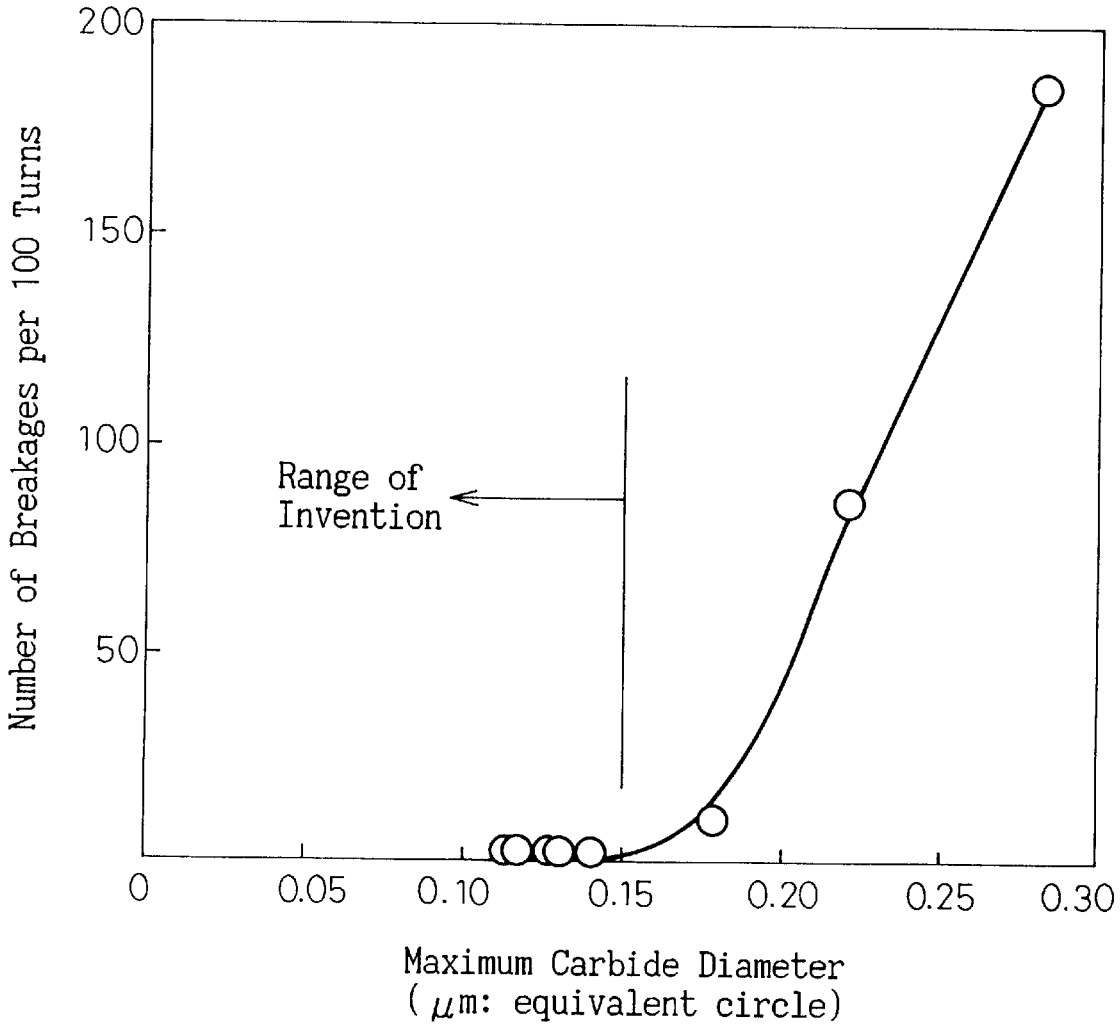
FIG. 3 is a graph showing the relationship between a carbide diameter and a number of breaks per 100 turns in wire-diameter coiling test on oil tempered steel wires.

FIG. 3 shows an arranged relationship between a carbide particle diameter and a number of breakage per 100 turns in wire-diameter coiling test in Examples 1 to 5, 8, 9 and 10. It is seen from FIG. 3 that although the number of breakage increases with a carbide particle diameter, no breakage occurs when the particle diameter is up to 0.15 μm.

Figure 4:
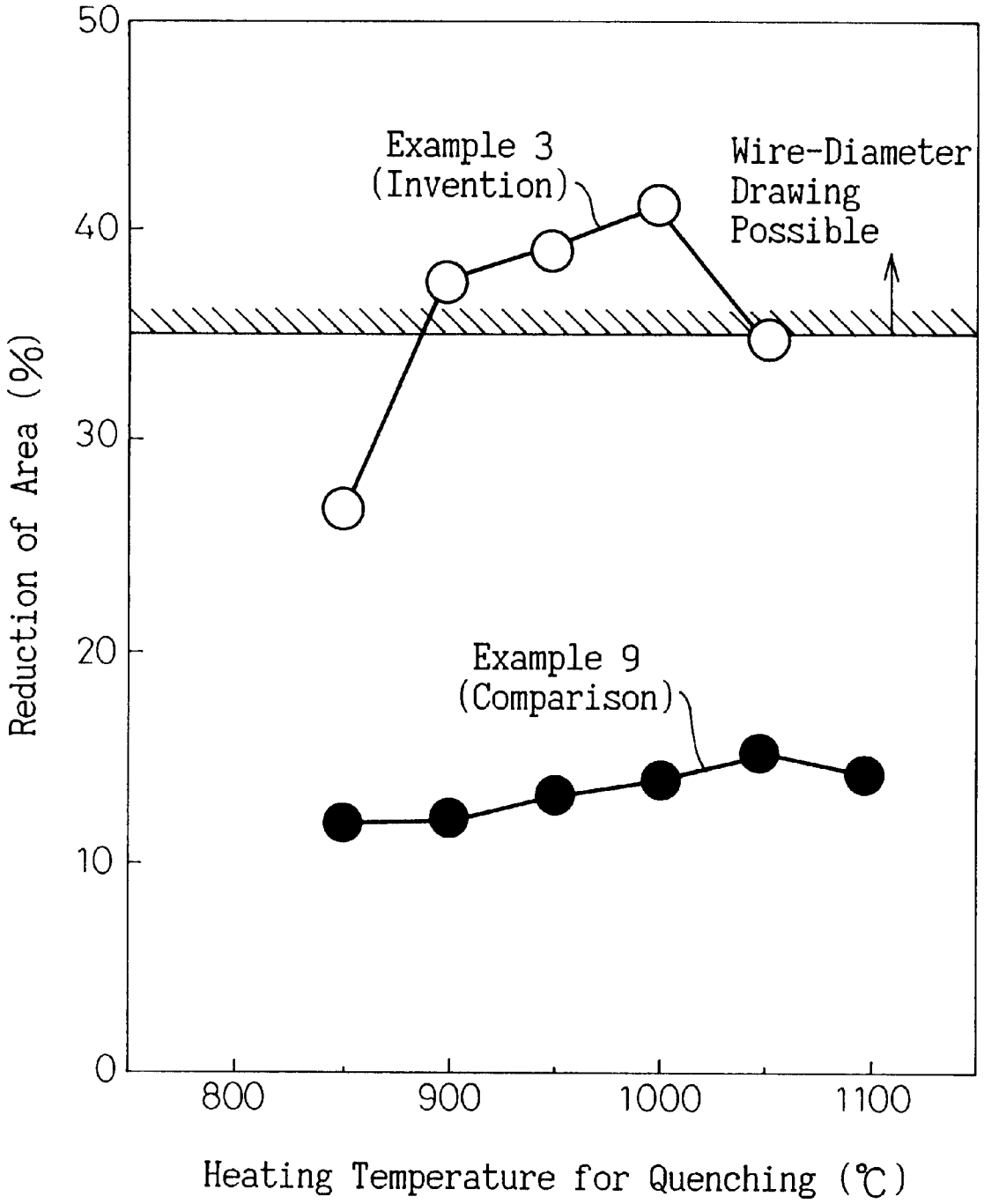
FIG. 4 is a graph showing the relationship between a heating temperature for quenching during oil tempering and a reduction of area in cold tensile test in Examples 3 and 9.

FIG. 4 shows the relationship between a heating temperature for quenching and a reduction of area in cold forming in Examples 3 and 9. When the steels are heated to a temperature of 900 to 1,000° C., the steels show a reduction of area of at least 35% at which the steels are not broken in wire-diameter coiling test.

As explained above, in Examples 1 to 5 to which the present invention was applied, the steels showed excellent properties near the final stress amplitude of 600 MPa.

Effect of Invention

Since the steel according to the present invention is designed to have a high C content, the contents of costly alloying elements for ensuring the strength can be suppressed to the lowest degree. Moreover, since the steel is made to have good hot deformability by making the austenite grain size fine with precipitates, the steel can be easily rolled. Furthermore, since the precipitates are controlled to have a size of up to 0.15 μm, the steel has good cold deformability after oil tempering. The steel can, therefore, be easily cold coiled to give springs. Consequently, springs having excellent fatigue characteristics can be produced at low cost.

We claim:

1. A high strength spring steel, comprising, based on weight, 0.65 to 0.85% of C, 1.90 to 2.40% of Si, 0.50 to 1.00% of Mn, 0.70 to 1.30% of Cr, 0.10 to 0.30% of Mo, 0.20 to 0.50% of V, 0.01 to 0.04% of Nb and the balance Fe and unavoidable impurities, carbides in the steel having a size of up to 0.15 μm in terms of equivalent circle.

2. The high strength spring steel according to claim 1, wherein the carbides in the steel mainly comprise V carbides and/or Nb carbides.

TABLE 1

Comparison of oil tempered steel wires

| | Chemical composition (wt. %) | | | | | | | Carbides | Hot | Wire | Breakage | Stress amplitude |
|---|---|---|---|---|---|---|---|---|---|---|---|---|
| Ex. | C | Si | Mn | Cr | Mo | V | Nb | μm | ductility | drawability | in forming | MPa |
| 1 Ex | 0.76 | 2.32 | 0.77 | 0.79 | 0.23 | 0.48 | 0.02 | 0.12 | ○ | ○ | ○ | 595 |
| 2 Ex | 0.75 | 2.00 | 0.71 | 1.10 | 0.21 | 0.24 | 0.03 | 0.14 | ○ | ○ | ○ | 593 |
| 3 Ex | 0.71 | 2.21 | 0.72 | 1.05 | 0.22 | 0.34 | 0.03 | 0.13 | ○ | ○ | ○ | 590 |
| 4 Ex | 0.82 | 2.01 | 0.61 | 1.22 | 0.27 | 0.33 | 0.04 | 0.13 | ○ | ○ | ○ | 595 |
| 5 Ex | 0.68 | 1.96 | 0.82 | 1.02 | 0.20 | 0.36 | 0.02 | 0.12 | ○ | ○ | ○ | 578 |
| 6 CE | 0.65 | 1.50 | 0.70 | 0.70 | — | — | — | — | x | — | — | — |
| 7 CE | 0.75 | 1.55 | 0.50 | 0.50 | 0.19 | 0.42 | — | — | x | — | — | — |
| 8 CE | 0.74 | 2.01 | 0.75 | 1.02 | 0.22 | 0.65 | 0.02 | 0.18 | ○ | ○ | x | — |
| 9 CE | 0.75 | 2.20 | 0.74 | 1.02 | 0.21 | 0.36 | 0.07 | 0.22 | ○ | ○ | x | — |
| 10 CE | 0.72 | 2.05 | 0.85 | 1.10 | 0.23 | 0.42 | 0.11 | 0.28 | ○ | ○ | x | — |
| 11 CE | 0.58 | 2.15 | 0.75 | 1.02 | 0.22 | 0.36 | 0.02 | 0.14 | ○ | ○ | ○ | 465 |

Note:
Hot ductility: The presence of microcracks was examined in Greeble hot tensile test at least at 1,100° C. Criteria: ○: no crack being formed; and x: cracks being formed
Breakage in forming: The presence of breakage was examined in wire-diameter coiling test subsequent to oil tempering. Criteria: ○: no breakage taking place; and x: breakage taking place
Test for evaluating fatique characteristics of a spring: average load stress $\tau_m$ = 686 MPa, number of loading N = 5 × $10^7$
Ex = Example, CE = Comparative Example

TABLE 2

Conditions in each step

| Step | Conditions | Evaluation test |
|---|---|---|
| rolling | heating temperature 900–1,250° C., rolling at 900–1,100° C. | inspection of rolling defects |
| heating, Pb patenting | heating at 910° C., held at 650° C. | |
| oil quenching tempering | quenching at 930° C., inert gas atmosphere, tempered at 480–500° C. | measurement of carbide size |
| cold coiling | in the same manner as in mass-production | wire-diameter coiling test |
| annealing | strain relief annealing at 400° C. for 30 min | |
| nitriding | 490–500° C. × 120 min | |
| shot peening | two step hard shot | |
| spring test | | fatique strength |

3. A process for producing a high strength spring steel, comprising the steps of heating a steel which comprises, based on weight, 0.65 to 0.85% of C, 1.90 to 2.40% of Si, 0.50 to 1.00% of Mn, 0.70 to 1.30% of Cr, 0.10 to 0.30% of Mo, 0.20 to 0.50% of V, 0.01 to 0.04% of Nb and the balance Fe and unavoidable impurities at temperature of 1,050 to 1,250° C., and rolling the steel subsequently so that carbides in the steel have a size of up to 0.15 μm in terms of equivalent circle.

4. The process according to claim 3, wherein the carbides in the steel mainly comprises vanadium carbides and/or niobium carbides.

5. The process according to claim 3, wherein the heating is conducted at temperature of 1,100 to 1,250° C.

6. The process according to claim 3, wherein the rolling is conducted at temperature of 900 to 1,100° C.

* * * * *